US007569766B2

(12) United States Patent
Moe et al.

(10) Patent No.: US 7,569,766 B2
(45) Date of Patent: Aug. 4, 2009

(54) COAXIAL CABLE INCLUDING TUBULAR BIMETALLIC INNER LAYER WITH ANGLED EDGES AND ASSOCIATED METHODS

(75) Inventors: Alan N. Moe, Hickory, NC (US); Larry W. Nelson, Hickory, NC (US)

(73) Assignee: CommScope, Inc. of North America, Hickory, NC (US)

( * ) Notice: Subject to any disclaimer, the term of this patent is extended or adjusted under 35 U.S.C. 154(b) by 0 days.

(21) Appl. No.: 11/957,042

(22) Filed: Dec. 14, 2007

(65) Prior Publication Data

US 2009/0151976 A1 Jun. 18, 2009

(51) Int. Cl.
*H01B 11/18* (2006.01)

(52) U.S. Cl. ..... 174/28; 174/102 R; 174/109

(58) Field of Classification Search ..... 174/28, 174/102 R, 106 R, 105 R, 126.1, 126.02, 174/109, 36

See application file for complete search history.

(56) References Cited

U.S. PATENT DOCUMENTS

| | | | | |
|---|---|---|---|---|
| 2,199,150 | A | 4/1940 | Chace | |
| 2,759,990 | A | 8/1956 | Bean | |
| 3,327,383 | A | 6/1967 | Reed | |
| 3,360,409 | A | 12/1967 | Jachimowicz et al. | |
| 3,405,228 | A | 10/1968 | Polizzano | |
| 3,541,221 | A | 11/1970 | Aupoix et al. | |
| 3,717,719 | A | 2/1973 | Smith et al. | 174/107 |
| 3,823,253 | A | 7/1974 | Walter et al. | 174/69 |
| 4,250,351 | A | 2/1981 | Bridges | 174/106 |
| 4,349,243 | A | 9/1982 | Amano et al. | 350/96.23 |
| 4,567,321 | A | 1/1986 | Harayama | 174/117 |
| 4,816,611 | A | 3/1989 | Invernizzi | 174/2 |
| 5,298,682 | A | 3/1994 | Salz | 174/105 |
| 5,500,488 | A | 3/1996 | Buckel | 174/102 |
| 5,946,798 | A * | 9/1999 | Buluschek | 29/828 |
| 6,137,058 | A | 10/2000 | Moe et al. | 174/102 |
| 6,201,189 | B1 | 3/2001 | Carlson et al. | 174/102 |
| 6,246,008 | B1 | 6/2001 | Fluckiger et al. | 174/126.1 |
| 6,342,677 | B1 * | 1/2002 | Lee | 174/106 R |
| 6,417,454 | B1 | 7/2002 | Biebuyck | 174/106 |
| 6,509,521 | B1 | 1/2003 | Geitz | 174/28 |
| 6,696,647 | B2 | 2/2004 | Ono et al. | 174/102 |
| 6,697,647 | B2 | 2/2004 | Higuchi et al. | 455/567 |
| 6,717,493 | B2 * | 4/2004 | Chopra et al. | 333/237 |
| 6,800,809 | B2 | 10/2004 | Moe et al. | 174/102 |
| 6,831,231 | B2 | 12/2004 | Perelman et al. | 174/102 |
| 6,953,888 | B2 | 10/2005 | Livshitz et al. | 174/28 |
| 6,963,032 | B2 | 11/2005 | Yamaguchi et al. | 174/102 |
| 7,034,228 | B2 | 4/2006 | Yokoi et al. | 174/102 |
| 2003/0051897 | A1 | 3/2003 | Blouin et al. | 174/106 |
| 2004/0089462 | A1 | 5/2004 | Buckel | 174/15.1 |
| 2004/0118591 | A1 * | 6/2004 | Bufanda et al. | 174/106 R |
| 2005/0092513 | A1 | 5/2005 | Brunker et al. | 174/102 |

* cited by examiner

*Primary Examiner*—William H Mayo, III
(74) *Attorney, Agent, or Firm*—Allen, Dyer, Doppelt, Milbrath & Gilchrist, P.A.

(57) ABSTRACT

A coaxial cable may include an inner conductor, an outer conductor and a dielectric material layer therebetween. The inner conductor may include a tubular bimetallic layer and may have a pair of opposing longitudinal edge portions at a longitudinal seam. The tubular bimetallic layer may include an inner metal layer and an outer metal layer bonded thereto and coextensive therewith. In addition, the opposing longitudinal edge portions may be angled inwardly to define a pair of adjacent inwardly extending tabs.

25 Claims, 3 Drawing Sheets

COAXIAL CABLE INCLUDING TUBULAR BIMETALLIC INNER LAYER WITH ANGLED EDGES AND ASSOCIATED METHODS

FIELD OF THE INVENTION

The present invention relates to the field of communications, and, more particularly, to coaxial cables and associated methods for making the coaxial cables.

BACKGROUND OF THE INVENTION

Coaxial cables are widely used to carry high frequency electrical signals. Coaxial cables enjoy a relatively high bandwidth, low signal losses, are mechanically robust, and are relatively low cost. A coaxial cable typically includes an elongate inner conductor, a tubular outer conductor, and dielectric separating the inner and outer conductors. For example, the dielectric may be a plastic foam material. An outer insulating jacket may also be applied to surround the outer conductor.

One particularly advantageous use of coaxial cable is for connecting electronics at a cellular or wireless base station to an antenna mounted at the top of a nearby antenna tower. For example, the transmitter and receiver located in an equipment shelter may be coupled via coaxial cables to antennas carried by the antenna tower. A typical installation includes a relatively large diameter main coaxial cable extending between the equipment shelter and the top of the antenna tower to thereby reduce signal losses. For example, CommScope, Inc. of Hickory, N.C. offers its CellReach® coaxial cable for such applications.

In larger diameter coaxial cables, which are commonly used in cellular communication as described above, the elongate inner conductor can be tubular in shape. The tubular inner conductor may also surround an inner dielectric material. The inner conductor is typically manufactured by forming a flat layer or sheet of conductive material into a tube with a longitudinal seam and welding the seam to form a continuous joint. The outer conductor is also similarly manufactured by forming a flat layer or metal sheet into a tube with a longitudinal seam that is welded to form a continuous joint.

The high frequency signals carried by the coaxial cable are concentrated in only a small portion, radially outermost, of the inner conductor, and a correspondingly small radially innermost portion of the outer conductor. This characteristic is attributed to the electromagnetic phenomenon called the skin effect. Therefore, only the thin outer radial portion of the tubular inner conductor carries the high frequency transmission. Conversely, the outer tubular conductor also carries the high frequency signals in the thin radially innermost portion.

Bimetallic layers have been used for the inner and/or outer tubular conductors in a coaxial cable where a higher conductivity and more expensive metal is used to provide the radially outermost portion of an inner conductor, and is used to provide the radially innermost portion of the outer conductor. For example, the outermost layer of the inner conductor may include a relatively costly and highly conductive metal such as copper, and the inner layer of the inner conductor may include a less costly and less conductive metal, such as aluminum. For example, U.S. Pat. No. 6,717,493 B2 to Chopra et al. and U.S. Patent Application No. 2004/0118591 A1 to Bufanda et al. each discloses a coaxial cable with such bimetallic tubular inner conductors.

Notwithstanding the benefits of a bimetal tubular inner conductor, there may be some shortcomings. For example, the manufacture of a bimetal tubular inner conductor usually involves some form of heat based welding, such as for example, conventional induction welding, to weld the seam to form a welded joint. Unfortunately, the two metals that form the bimetal tubular inner conductor usually have different melting temperatures. For example, copper and aluminum are commonly used as the outer and inner layers of the inner conductor, respectively. Copper has a melting point of 1100° C. and a conductivity of $59.6\times10^{6}\ S\cdot m^{-1}$, while aluminum has a lower melting point of 660° C. and a lower conductivity of $37.8\times10^{6}\ S\cdot m^{-1}$. This disparity in melting points makes welding of the joint relatively difficult.

In response to this particular shortcoming in manufacture of bimetal tubular inner conductors, coaxial cable manufacturers have developed a coaxial cable with a bimetal tubular inner conductor comprising an inlaid bimetallic layer, such as disclosed, for example, in U.S. Pat. No. 6,342,677 to Lee. This coaxial cable is more easily welded since only the inner metal layer is welded during manufacture of the bimetal tubular inner conductor. Nonetheless, the inlaid bimetal inner conductor is relatively costly to manufacture. Of course, similar considerations apply to the outer conductor of a coaxial cable. That is a conventional bimetallic layer may be difficult to weld, and an inlaid bimetallic layer may be relatively expensive.

SUMMARY OF THE INVENTION

In view of the foregoing background, it is therefore an object of the present invention to provide a coaxial cable including an inner conductor using a less expensive tubular bimetallic layer and associated methods.

This and other objects, features and advantages in accordance with the present invention are provided by a coaxial cable comprising an inner conductor including a tubular bimetallic layer and having a pair of opposing longitudinal edge portions at a longitudinal seam. The tubular bimetallic layer may comprise an inner metal layer and an outer metal layer bonded thereto and coextensive therewith. The opposing longitudinal edge portions may be angled inwardly to define a pair of adjacent inwardly extending tabs. The outer metal layer may have a higher electrical conductivity than the inner metal layer. Accordingly, a less expensive starting material may be used for the inner conductor, that is, a simple bimetallic strip, as compared to the more expensive inlaid bimetallic strip, for example.

The longitudinal seam may comprise a joint between the opposing longitudinal edge portions of the outer metal layer. Moreover, the joint may comprise at least one of a welded joint, an adhesive joint, and a soldered joint, for example.

The inner metal layer may comprise aluminum, and the outer metal layer may comprise copper. The tubular bimetallic layer may have a thickness in a range of about 0.005 to 0.050 inches. In addition, the outer metal layer may have a percentage thickness relative to an overall thickness of the tubular bimetallic layer in a range of about 1 to 30%.

The coaxial cable may further comprise another dielectric material layer filling the tubular bimetallic layer. In addition, the coaxial cable may further include an insulating jacket surrounding the outer conductor.

A method aspect is for making a coaxial cable comprising an inner conductor, an outer conductor and a dielectric material layer therebetween. The method may include forming the inner conductor by at least forming a bimetallic strip into a tubular bimetallic layer having a pair of opposing longitudinal edge portions angled inwardly to define a pair of adjacent inwardly extending tabs at a longitudinal seam with the tubular bimetallic layer comprising an inner metal layer and an outer metal layer bonded thereto and coextensive therewith. The method may further include forming the dielectric material layer surrounding the inner conductor, and forming the outer conductor surrounding the dielectric material layer.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
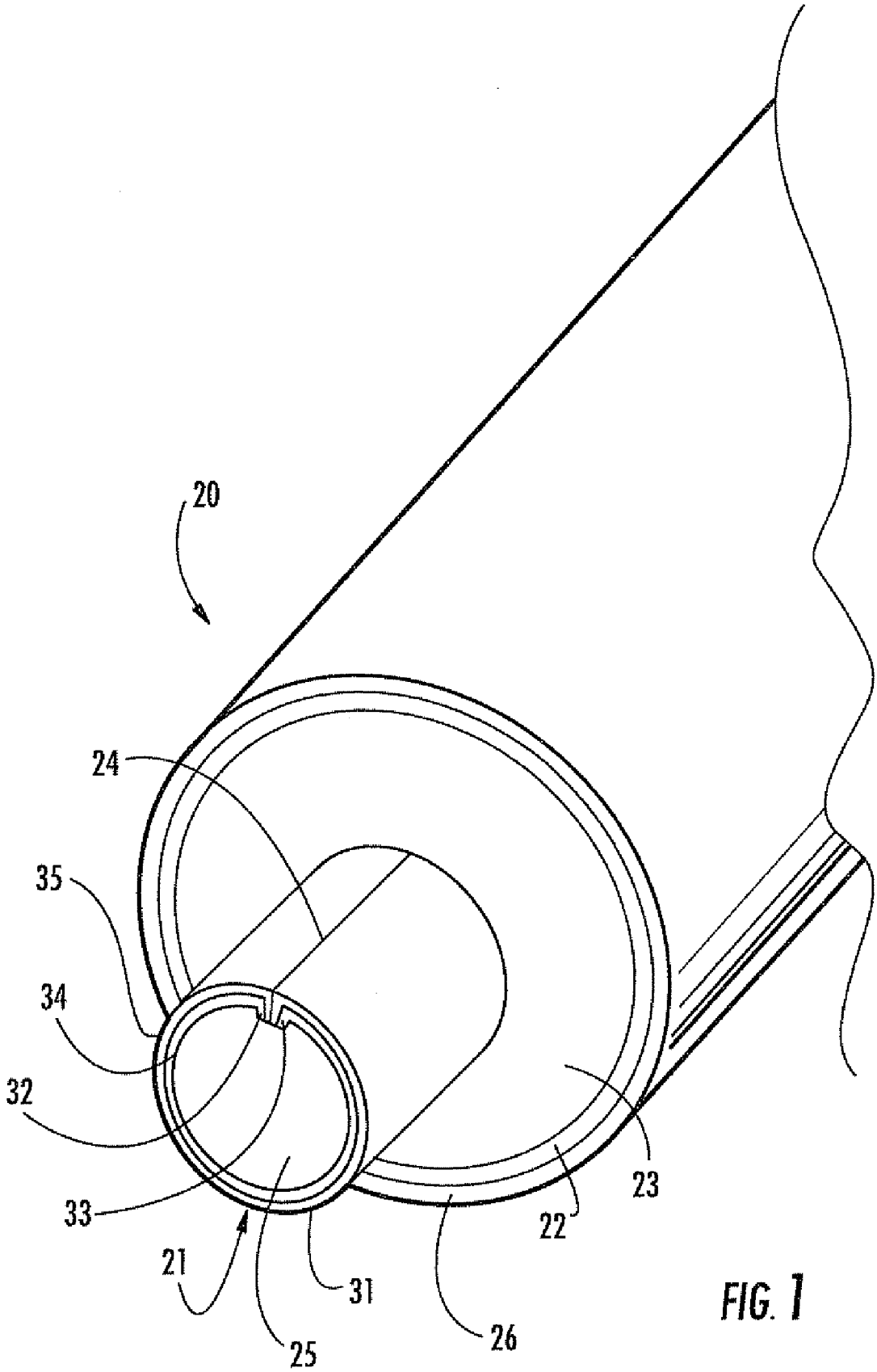
FIG. 1 is a perspective end view of a coaxial cable in accordance with the present invention.
Figure 2:
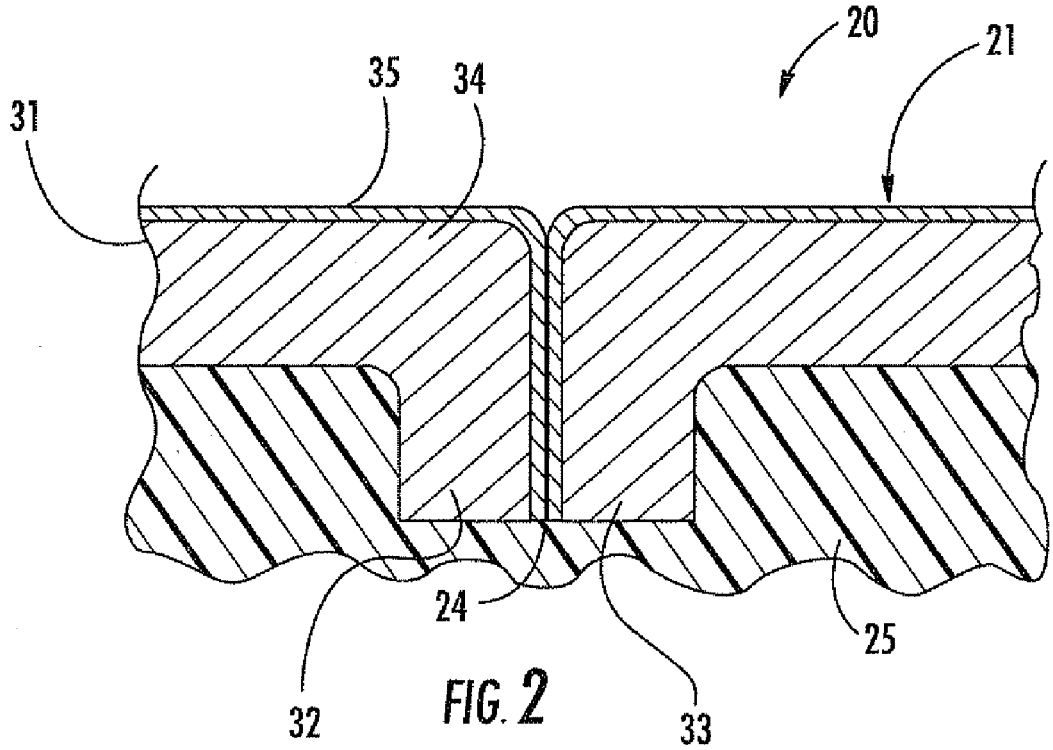
FIG. 2 is an enlarged cross-sectional view of a portion of the tubular bimetallic inner conductor of the coaxial cable of FIG. 1.

Referring initially to FIGS. 1-2, a coaxial cable 20 including an inner conductor 21 in accordance with the present invention is now described. The coaxial cable 20 also illustratively includes an outer conductor 22 and a dielectric material layer 23 between the inner conductor 21 and the outer conductor. The inner conductor 21 illustratively includes a tubular bimetallic layer 31 that has a pair of opposing longitudinal edge portions at a longitudinal seam 24. The tubular bimetallic layer 31 includes an inner metal layer 34 and an outer metal layer 35 bonded thereto and coextensive therewith.

The opposing longitudinal edge portions are illustratively angled inwardly to define a pair of adjacent inwardly extending tabs 32, 33. The adjacent inwardly extending tabs 32, 33 are illustratively angled radially inwardly, although in other embodiments, the angle may be different from radial as will be appreciated by those skilled in the art. Moreover, in some embodiments, these inwardly extending tabs 32, 33 may be considered to define a "tail" that extends for a greater depth, and not necessarily in a radial or linear direction, into the dielectric material layer 25 illustratively filling the tubular bimetallic layer 31.

The outer metal layer 35 may have a higher electrical conductivity than the inner metal layer 34 to facilitate signal carrying ability at the skin depth, for example. The inner metal layer 34 may comprise aluminum or any other suitable metal as will be appreciated by one skilled in the art. The outer metal layer 35 may comprise copper or any other suitable metal as will be appreciated by one skilled in the art.

Exemplary dimensions of the tubular bimetallic layer 31 are as follows. The tubular bimetallic layer 31 may have a thickness in a range of about 0.005 to 0.050 inches. In addition, the outer metal layer 35 may have a percentage thickness relative to an overall thickness of the tubular bimetallic layer 31 in a range of about 1 to 30%, for example.

The coaxial cable 20 illustratively includes the dielectric material layer 25 filling the tubular bimetallic layer 31. The dielectric material layer 25 may be provided as a dielectric rod or a dielectric foam, such as formed using a settable material as described in U.S. Pat. No. 6,915,564, for example, also assigned to the assignee of the present invention, and the entire contents of which are incorporated herein by reference. The coaxial cable 20 illustratively includes an insulating jacket 26 surrounding the outer conductor 22. In some embodiments the jacket may not be needed.

Figure 3:
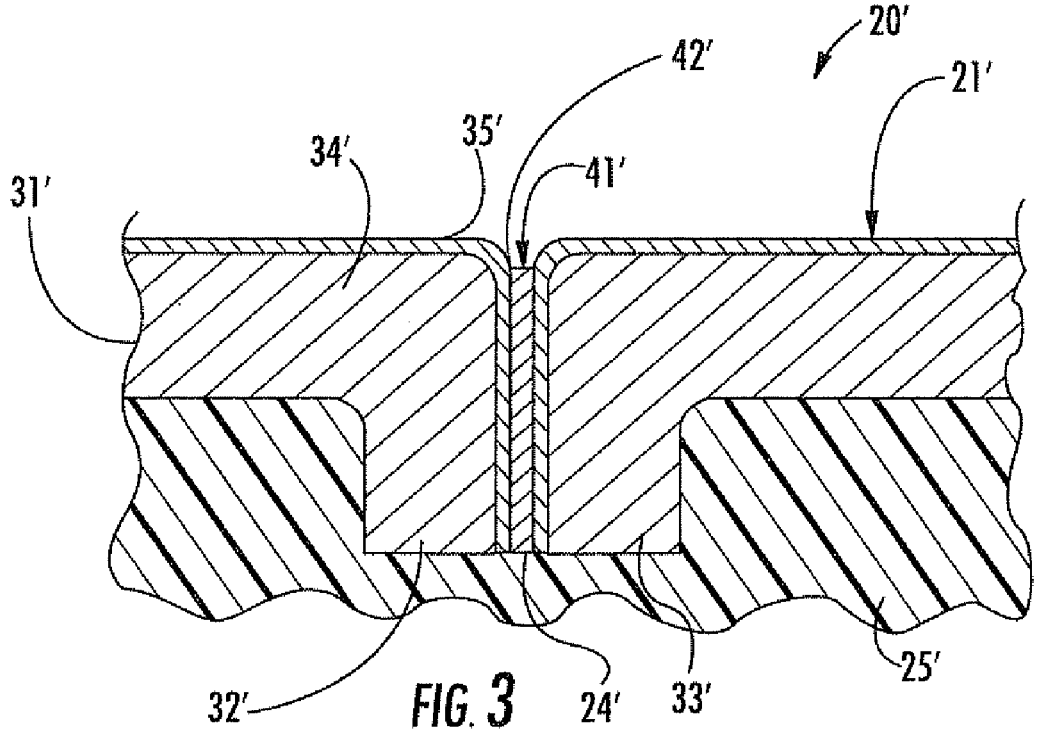
FIG. 3 is an enlarged cross-sectional view of a portion of the tubular bimetallic inner conductor of another embodiment of the coaxial cable in accordance with the present invention.

Referring now additionally to FIG. 3, another embodiment is now described. In this embodiment of the coaxial cable 20', those elements already discussed above with respect to FIGS. 1-2 are given prime notation and most require no further discussion herein. This embodiment differs from the previous embodiment in that the longitudinal seam 24' illustratively comprises a joint 41' between the opposing longitudinal edge portions of the outer metal layer 35'. In other words, the opposing end portions defining the seam 24 as shown in FIGS. 1 and 2 need not necessarily be joined together. However, in the embodiment of the coaxial cable 20' described with reference to FIG. 3, the seam 24' illustratively comprises a joint 41' wherein the edges are joined together.

Figure 4:
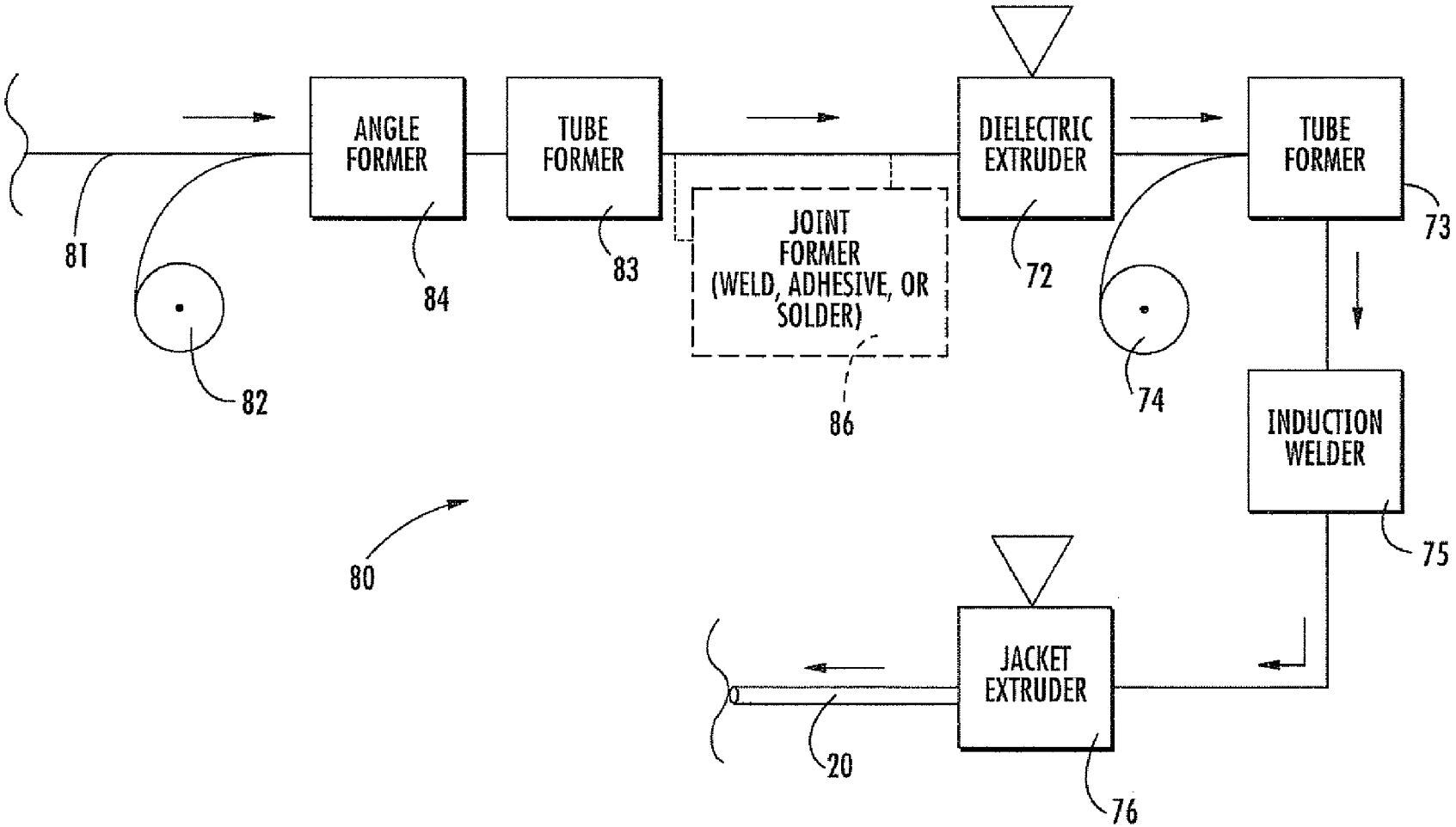
FIG. 4 is schematic diagram of an apparatus for making the coaxial cable in accordance with the present invention.

This joint 41' is illustratively provided by an intervening layer 42' between adjacent portions of the outer metal layer 35'. The joint 41' may comprise at least one of a welded joint, an adhesive joint, and a soldered joint, for example, as will be appreciated by those skilled in the art. Those of skill in the art will appreciate techniques and associated materials to form any of these joint types without further discussion herein Referring now additionally to FIG. 4, another aspect relates to a method and apparatus 80 for making the coaxial cable 20 including the inner conductor 21 comprising the tubular bimetallic layer 31. A dielectric material rod 81 and the bimetallic strip from the supply reel 82 of bimetallic strip are fed into the angle former 84. The angle former 84 bends the longitudinal edge portions of the bimetallic strip.

The output of the angle former 84 is fed into the tube former 83. The tube former 83 forms the bimetallic strip into an inner conductor comprising a tubular bimetallic layer having a pair of opposing longitudinal edge portions angled inwardly to define a pair of adjacent inwardly extending tabs at a longitudinal seam. As will be appreciated by those skilled in the art, in other embodiments the dielectric material may be formed inside the inner conductor downstream from the tube former 83 such as using a settable material as described in U.S. Pat. No. 6,915,564, the entire contents of which are incorporated herein by reference.

Although optional, the longitudinal seam may comprise a joint between portions of the outer metal layer. As shown with dashed lines, the output of the tube former 83 may be fed into the joint former 86 to form a welded joint, an adhesive joint, or a soldered joint as discussed above. The inner conductor can be fed from the output of the tube former 83 into the dielectric extruder 72.

The dielectric extruder 72 forms the dielectric material layer surrounding the inner conductor. The output of the dielectric extruder 72 is then fed into a second tube former 73 along with another metallic strip from a supply reel 74.

The second tube former 73 forms the outer conductor surrounding the dielectric material layer. The output of the second tube former 73 is illustratively fed into an induction welder 75, which welds the longitudinal edges of the outer conductor.

The output from the induction welder 75 is fed into a jacket extruder 76, which illustratively forms an insulating jacket surrounding the outer conductor. The fabricated coaxial cable

20 with the inner conductor comprising the tubular bimetallic layer is output from the jacket extruder 76 for take-up on a suitable take-up reel, not shown.

This application is related to copending patent applications entitled, COAXIAL CABLE INCLUDING TUBULAR BIMETALLIC INNER LAYER WITH BEVELLED EDGE JOINT AND ASSOCIATED METHODS, application Ser. No. 11/957,020; COAXIAL CABLE INCLUDING TUBULAR BIMETALLIC INNER LAYER WITH FOLDED EDGE PORTIONS AND ASSOCIATED METHODS, application Ser. No. 12/394,941; COAXIAL CABLE INCLUDING TUBULAR BIMETALLIC OUTER LAYER WITH BEVELLED EDGE JOINT AND ASSOCIATED METHODS, application Ser. No. 11/957,070; COAXIAL CABLE INCLUDING TUBULAR BIMETALLIC OUTER LAYER WITH ANGLED EDGES AND ASSOCIATED METHODS, application Ser. No. 11/957,089; and COAXIAL CABLE INCLUDING TUBULAR BIMETALLIC OUTER LAYER WITH FOLDED EDGE PORTIONS AND ASSOCIATED METHODS, application Ser. No. 11/957,100 which are filed on the same date and by the same assignee and inventors, the disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. A coaxial cable comprising:

an inner conductor, an outer conductor and a dielectric material layer therebetween;

said inner conductor comprising a tubular bimetallic layer and having a pair of opposing longitudinal edge portions at a longitudinal seam;

said tubular bimetallic layer comprising an inner metal layer and an outer metal layer bonded thereto and coextensive therewith;

said opposing longitudinal edge portions being angled inwardly to define a pair of adjacent inwardly extending tabs that include both said inner metal layer and said outer metal layer.

2. A coaxial cable according to claim 1 wherein said outer metal layer has a higher electrical conductivity than said inner metal layer.

3. A coaxial cable according to claim 1 wherein the longitudinal seam comprises a joint between the opposing longitudinal edge portions of said outer metal layer.

4. A coaxial cable according to claim 3 wherein said joint comprises at least one of a welded joint, an adhesive joint, and a soldered joint.

5. A coaxial cable according to claim 1 wherein said inner metal layer comprises aluminum.

6. A coaxial cable according to claim 1 wherein said outer metal layer comprises copper.

7. A coaxial cable according to claim 1 wherein said tubular bimetallic layer has a thickness in a range of about 0.005 to 0.050 inches.

8. A coaxial cable according to claim 1 wherein said outer metal layer has a percentage thickness relative to an overall thickness of said tubular bimetallic layer in a range of about 1 to 30%.

9. A coaxial cable according to claim 1 further comprising another dielectric material layer filling said tubular bimetallic layer.

10. A coaxial cable according to claim 1 further comprising an insulating jacket surrounding said outer conductor.

11. A coaxial cable comprising:

an inner conductor, an outer conductor and a dielectric material layer therebetween;

said inner conductor comprising a tubular bimetallic layer having a pair of opposing longitudinal edge portions at a longitudinal seam;

said tubular bimetallic layer comprising an inner metal layer and an outer metal layer bonded thereto and coextensive therewith, said outer metal layer having a higher electrical conductivity than said inner metal layer;

said opposing longitudinal edge portions being angled radially inwardly to define a pair of adjacent radially inwardly extending tabs that include both said inner metal layer and said outer metal layer;

the longitudinal seam comprising a joint between the opposing longitudinal edge portions of said outer metal layer.

12. A coaxial cable according to claim 11 wherein said joint comprises at least one of a welded joint, an adhesive joint, and a soldered joint.

13. A coaxial cable according to claim 11 wherein said inner metal layer comprises aluminum; and wherein said outer metal layer comprises copper.

14. A coaxial cable according to claim 11 wherein said tubular bimetallic layer has a thickness in a range of about 0.005 to 0.050 inches.

15. A coaxial cable according to claim 11 wherein said outer metal layer has a percentage thickness relative to an overall thickness of said tubular bimetallic layer in a range of about 1 to 30%.

16. A coaxial cable according to claim 11 further comprising another dielectric material layer filling said tubular bimetallic layer.

17. A coaxial cable according to claim 11 further comprising an insulating jacket surrounding said outer conductor.

18. A method for making a coaxial cable comprising an inner conductor, an outer conductor and a dielectric material layer therebetween, the method comprising:

forming the inner conductor by at least forming a bimetallic strip into a tubular bimetallic layer having a pair of opposing longitudinal edge portions angled inwardly to define a pair of adjacent inwardly extending tabs at a longitudinal seam, the tubular bimetallic layer comprising an inner metal layer and an outer metal layer bonded thereto and coextensive therewith, the inwardly extending tabs including both the inner metal layer and the outer metal layer;

forming the dielectric material layer surrounding the inner conductor; and forming the outer conductor surrounding the dielectric material layer.

19. A method according to claim 18 wherein the outer metal layer has a higher electrical conductivity than the inner metal layer.

20. A method according to claim 18 wherein the inner metal layer comprises aluminum.

21. A method according to claim 18 wherein the outer metal layer comprises copper.

22. A method according to claim 18 wherein the longitudinal seam comprises a joint between the opposing longitudinal edge portions of the outer metal layer.

23. A method according to claim 22 wherein the joint comprises at least one of a welded joint, an adhesive joint, and a soldered joint.

24. A method according to claim 18 wherein the tubular bimetallic layer has a thickness in a range of about 0.005 to 0.050 inches.

25. A method according to claim 18 wherein the outer metal layer has a percentage thickness relative to an overall thickness of the tubular bimetallic layer in a range of about 1 to 30%.

* * * * *

UNITED STATES PATENT AND TRADEMARK OFFICE

CERTIFICATE OF CORRECTION

PATENT NO. : 7,569,766 B2
APPLICATION NO. : 11/957042
DATED : August 4, 2009
INVENTOR(S) : Moe et al.

It is certified that error appears in the above-identified patent and that said Letters Patent is hereby corrected as shown below:

| | |
|---|---|
| Title Page, Section 73 | Delete: "CommScope, Inc. of North America"<br>Insert -- CommScope, Inc. of North Carolina -- |

Signed and Sealed this

First Day of December, 2009

David J. Kappos

David J. Kappos
*Director of the United States Patent and Trademark Office*